United States Patent [19]

Schuhmann et al.

[11] Patent Number: 4,559,874

[45] Date of Patent: Dec. 24, 1985

[54] INK METERING SYSTEM IN LETTERPRESS AND OFFSET PRINTING MACHINES

[75] Inventors: Siegfried Schuhmann, Offenbach am Main; Günther Schniggenfittig, Muhlheim am Main, both of Fed. Rep. of Germany

[73] Assignee: M.A.N.-Roland Druckmaschinen Aktiengesellschaft, Offenbach am Main, Fed. Rep. of Germany

[21] Appl. No.: 627,794

[22] Filed: Jul. 5, 1984

[30] Foreign Application Priority Data

Jul. 7, 1983 [DE] Fed. Rep. of Germany ..... 3324445

[51] Int. Cl.[4] ..... B41F 31/14

[52] U.S. Cl. ..... 101/350; 101/148

[58] Field of Search ..... 101/DIG. 6, 348–350, 101/148

[56] References Cited

U.S. PATENT DOCUMENTS

| | | | |
|---|---|---|---|
| 2,788,741 | 4/1957 | Skobb | 101/350 |
| 3,037,449 | 6/1962 | Aller | 101/350 |
| 3,261,287 | 7/1966 | Brodie | 101/350 |
| 3,417,692 | 12/1968 | Brodie | 101/350 |
| 3,552,311 | 1/1971 | Petri | 101/350 |
| 4,402,263 | 9/1983 | Honkawa | 101/350 |
| 4,467,720 | 8/1984 | Gertsch | 101/348 |

FOREIGN PATENT DOCUMENTS

| | | | |
|---|---|---|---|
| 2924635 | 1/1981 | Fed. Rep. of Germany | 101/350 |

*Primary Examiner*—William Pieprz

*Attorney, Agent, or Firm*—Leydig, Voit & Mayer

[57] ABSTRACT

An ink metering system for letterpress and offset printing machines is provided in which the duct roller, the ink vibrator discs and the transfer roller have a low circumferential speed and wherein the ink is accelerated by suitable vibrator devices to higher speeds corresponding to the circumferential speed of the plate cylinder. The ink vibrator discs are controlled under defined conditions by various lever systems in order that the ink may be transferred controllably and in optimum manner without any empty gaps. The ink vibrator discs can also be readily removed and fitted for repair and cleaning purposes.

3 Claims, 4 Drawing Figures

Fig. 3.
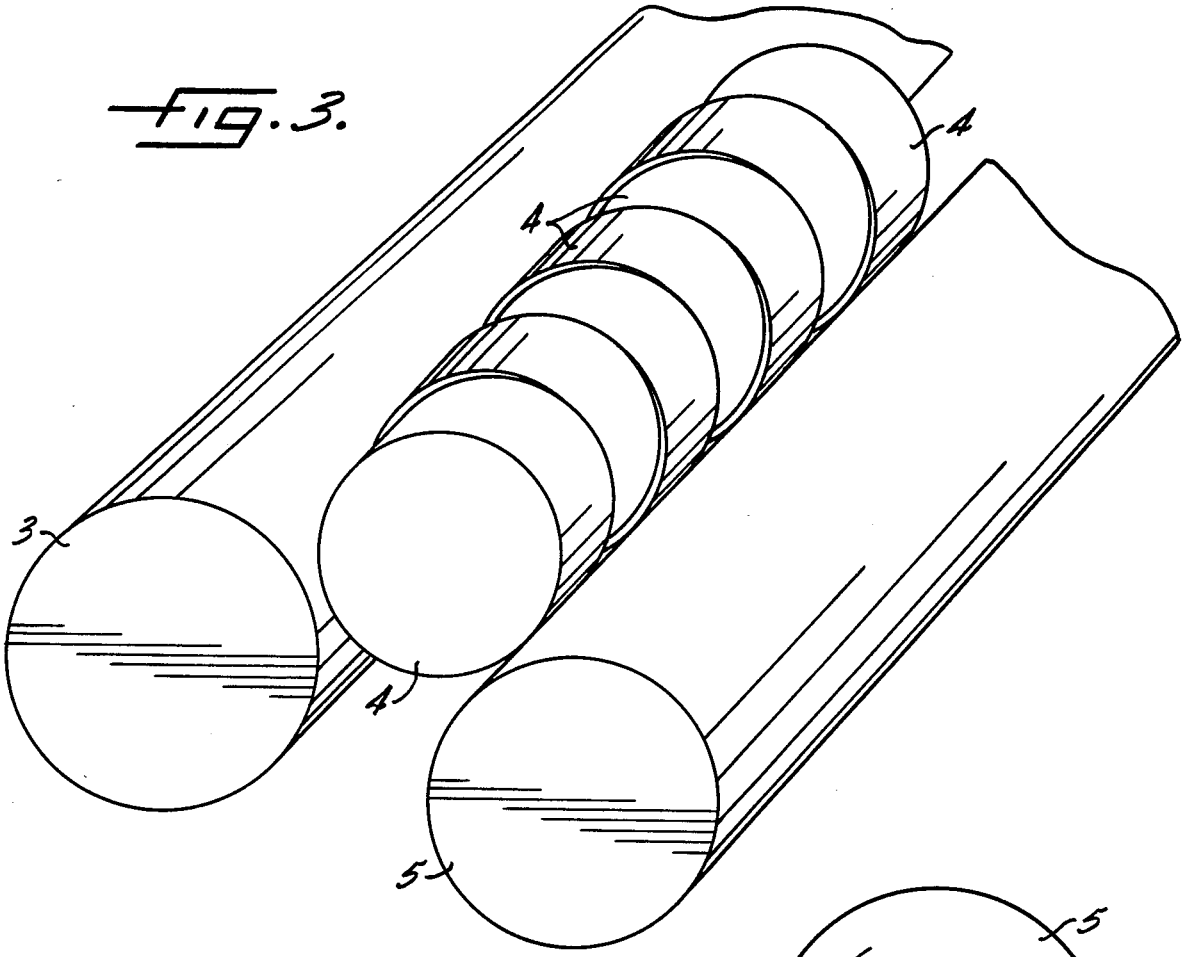
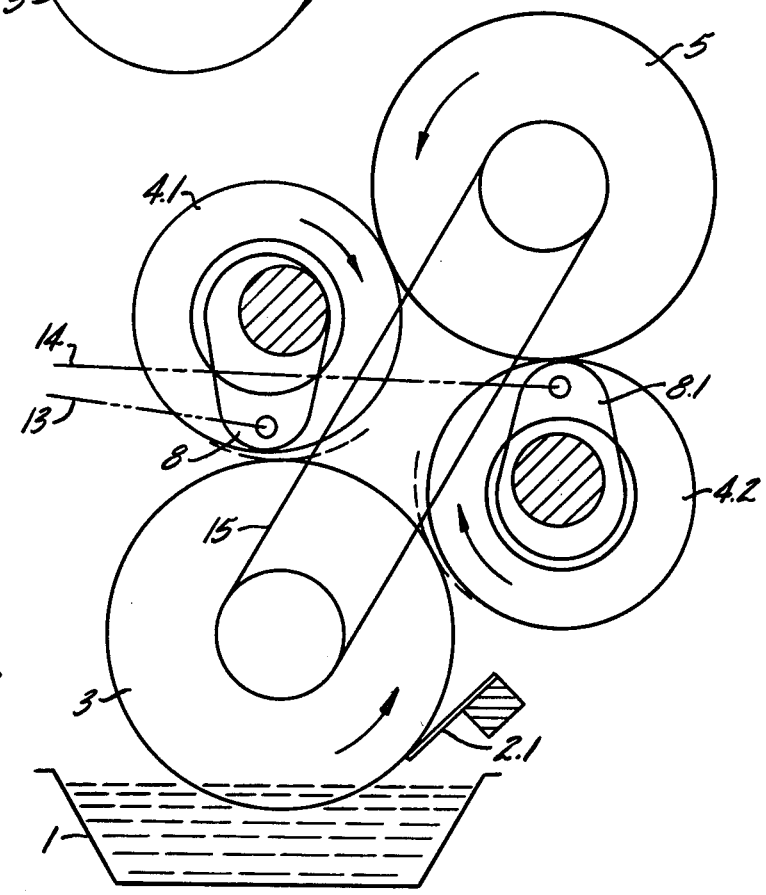
Fig. 4.

INK METERING SYSTEM IN LETTERPRESS AND OFFSET PRINTING MACHINES

FIELD OF THE INVENTION

This invention relates generally to an ink metering system for letterpress and offset printing machines, and more particularly concerns a plurality of discs disposed side by side, which oscillate individually and independently of one another between the duct roller and a transfer roller of the machine and wherein the width of each disc corresponds to a specific ink zone.

BACKGROUND OF THE INVENTION

To obtain good ink transfer for any particular printing run, various solutions have been disclosed in the form of divided vibrator rollers. For example, Swiss Patent Specification No. 169 362 discloses an inking unit for rotary printing machines, comprising a plurality of vibrator rollers disposed side by side on a common shaft and adapted to be individually brought into and out of operation, the length of each roller corresponding to the width of a printing plate. A control system comprising a plurality of cams of different shapes disposed side by side and longitudinally movable on a common shaft is provided for each vibrator roller. The object of this system is to enable the ink delivery for each individual page with respect to the position of the ink strips to be controlled from a central point during operation.

In East German Patent Specification No. 104 259 there is disclosed a press whose object is to allow programmed adjustment of predetermined and/or calculated metered quantities of ink and obviate any disturbances in ink delivery during continuous printing by control means according to machine requirements. To this end, a system is provided for dispensing the ink in offset and letterpress printing machines without the use of zone screws and duct blades. To obtain a predetermined uniform inking on the sheet in printing solid areas, the ink film thickness required for each ink and paper combination used is obtained by fine adjustment of a nip between the duct roller and a co-acting roller and/or by differential speed between these two rollers. The zone discs are guided with mounting on only one side.

Referring to West German Patent Specification No. 2 924 635 there is disclosed an ink metering system for letterpress and offset printing machines which is substantially independent of paper constituents and damping water and which enables ink to be supplied according to plate inking requirements. This objective is said to be achieved by an ink metering system consisting of a duct and blade and a duct roller with a vibrator for electronic ink zone remote-control in letterpress and offset printing machines, a plurality of ink vibrator wheels being provided, which oscillate individually and independently of one another and the width of each of which corresponds to a specific ink zone.

All these known systems divide the vibrator roller up into a plurality of transfer rollers arranged side by side in the form of discs, each of which has to be laterally supported for positioning purposes. This results in a large gap between the individual ink transfer rollers if the latter are supported on both sides. However, the disclosed mounting is inadequate to take the forces during the transfer of the ink from the duct roller, particularly to a spreader roller rotating at higher circumferential speed. Accordingly, there is always the possibility of lateral deflection during the contact of the vibrator discs and the spreader, because of the narrow mounting plates and since deflection occurs during each contact with the spreader roller there is ultimately the risk of the mounting plate breaking. With regard to the control for the ink vibrator or disc wheels, all that is stated is that this can be carried out as required, but no indication is given of the technical means required. Also, the speed difference between the duct roller and the spreader roller has to be compensated on each contact, and this results in considerable abrasion of the transfer roller surfaces.

SUMMARY OF THE INVENTION

The primary aim of the present invention is to provide an ink metering system which allows ink transfer from the duct roller to the transfer roller without any empty gaps between two adjacent vibrator discs, the latter being readily interchangeable. Accordingly, there is provided an ink metering system for use with letterpress and offset printing machines including an ink duct with a blade and a duct roller with an ink vibrator, the latter consisting of a plurality of ink vibrator discs, which oscillate individually and independently of one another between the duct roller and a transfer roller, and wherein the width of each of the discs corresponds to a specific ink zone, characterized in that the duct roller and the transfer roller are driven at the same circumferential speed, which is lower than the other inking unit rollers; the ink vibrator discs being driven by frictional contact with the transfer roller and the duct roller; while being in continuous contact therewith; and means for bringing the ink vibrator discs into contact with the duct roller and the transfer roller under controllably defined conditions by means of an actuating lever system.

Preferably the circumstantial speeds of the rollers participating in the ink metering are equal, i.e., the ink can be metered at the rollers without any slip and the ink is transferred from the duct to the duct roller with a gap width preset at the ink spreaders. After one revolution of the duct roller the ink is returned to the duct unless it has been taken off the duct roller by the vibrator discs. In this way metering in the zero-flow range can be carried out very simply and accurately. When ink is transferred, the vibrator discs are in contact with the transfer roller and if the vibrator discs are brought into brief contact with the duct roller then there is low ink metering.

The contact between the ink vibrator disc and the duct roller determines the amount of ink to be transferred during metering. If the ink vibrator disc is in continual contact with the duct roller, that position is the maximum ink transfer position. The time of contact between the vibrator discs and the duct roller determines the length of the ink strip for transfer to the transfer roller. The ink vibrator disc is preferably in continual contact with the transfer roller, thus ensuring controlled ink supply. To this end, the ink vibrator discs can be so controlled that the contact times of the ink vibrator discs correspond to the ink requirements at any particular areas of the printed text. Various lever systems are provided for the defined control of the contact time of the vibrator discs, according to the ink metering system selected.

From the slow-running ink transfer roller the ink is transferred by suitable vibrator means to the circumferential speed corresponding to the machine speed or plate cylinder speed. Conventional reciprocating rocking vibrators can be used for this purpose, or rotating vibrators equipped on two sides.

The ink vibrator discs are disposed in contiguous relationship and have no empty gaps, so that there is optimum ink transfer to the transfer roller and there is no need for any spreading directly after the ink transfer. The spreading in the area of the plate cylinder is sufficient for this purpose.

Another embodiment of the invention provides a double row of ink vibrator discs arranged in staggered relationship to one another. In this embodiment the duct roller and the transfer roller are interconnected by a drive belt and the thickness of the film of ink is scraped off by a blade to a preset thickness and transferred by the ink vibrator discs according to the contact time. As stated above, various lever systems are provided for the control of the ink vibrator discs.

Other objects and advantages of the invention will be apparent upon reference to the following description taken in conjunction with the exemplified embodiments illustrated diagrammatically in the drawings and upon reading the appended claims.

BRIEF DESCRIPTION OF THE DRAWINGS

FIG. 3 is a schematic perspective view of the system shown in FIG. 2; and, FIG. 4 shows a construction with two opposite rows of ink vibrator discs between the duct roller and the transfer roller.

DETAILED DESCRIPTION OF THE INVENTION

Figure 1:
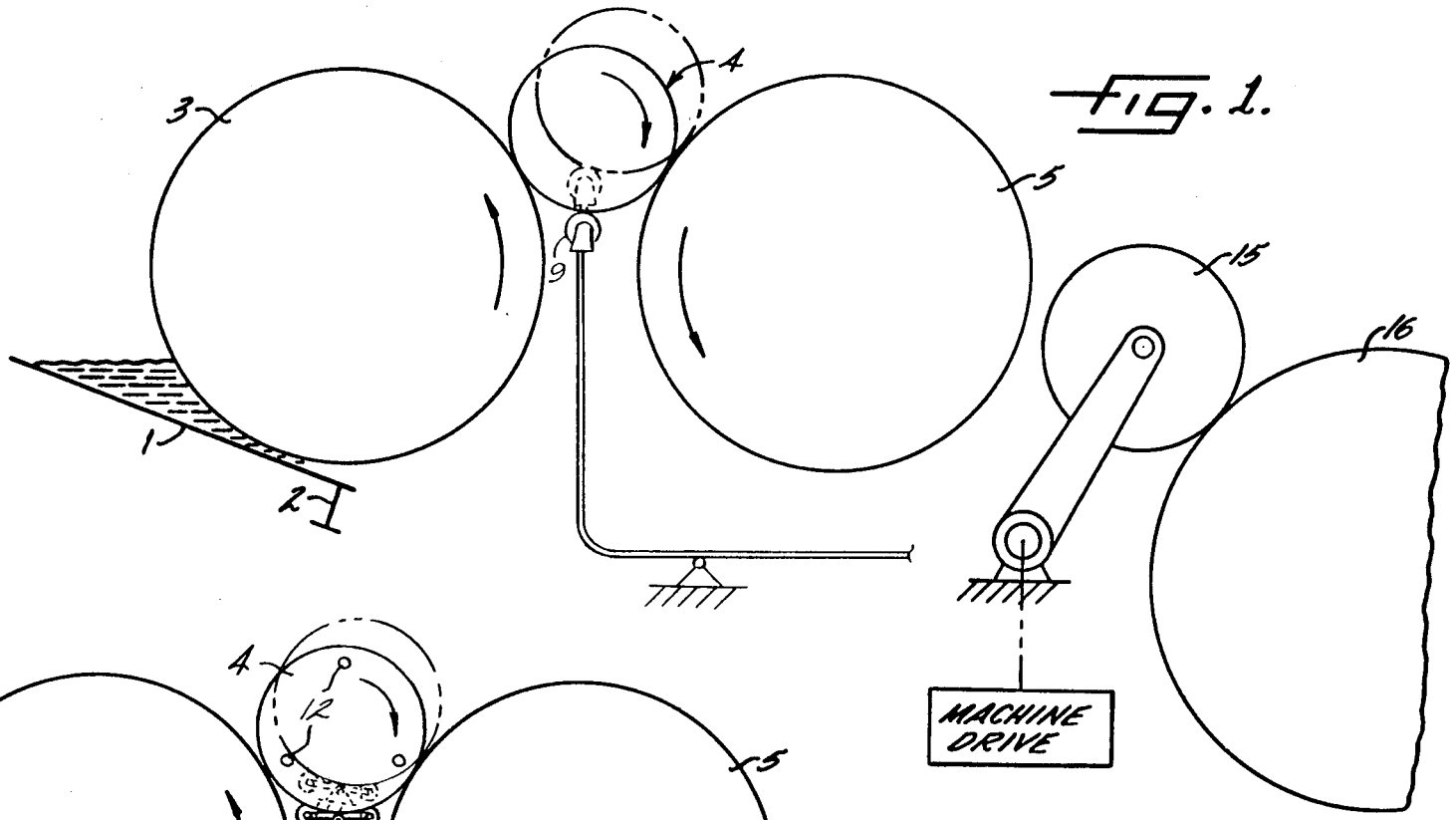
FIG. 1 is a schematic illustration of an ink metering system with ink vibrator discs disposed between a duct roller and a transfer roller in a printing press.

Turning now to FIG. 1, there is shown an ink metering system for a printing press with a duct 1 and a duct blade 2 adjacent a duct roller 3, the blade 2 being at a preset gap from the roller 3 so that a constant defined film of ink is applied to the roller 3 from the duct 1. The film of ink applied to the roller 3 can be transferred to a transfer roller 5 by a series of closely spaced vibrator discs 4. A greater or smaller amount of ink is transferred to the transfer roller depending upon the length of time during which the vibrator discs are in contact with the duct roller 3.

The ink vibrator discs 4 are controlled by way of a lever system 6, at the end of which is disposed a support roller 9. The control procedure is preferably such that the ink vibrator discs 4 are in constant contact with the transfer roller 5 as shown in the phantom line position of FIG. 1, and are adapted to contact the duct roller 3 by the lowering of the roller 9 as shown in the solid line position of FIG. 1 in order to take ink from the roller 3. The circumferential speeds of the rollers 3 and 5 are variable and generally are considerably less than the circumferential speed of the other rollers of the inking unit.

A vibrator 15 is disposed between the transfer roller 5 and an inking unit roller 16. The vibrator 15 can also be designed as a rotating vibrator at which two rollers are provided for transfer of the ink, in order to accelerate the ink from the slow circumferential speed of the duct roller 3 to the circumferential speed of the machine rollers corresponding to the plate cylinder.

Figure 2:
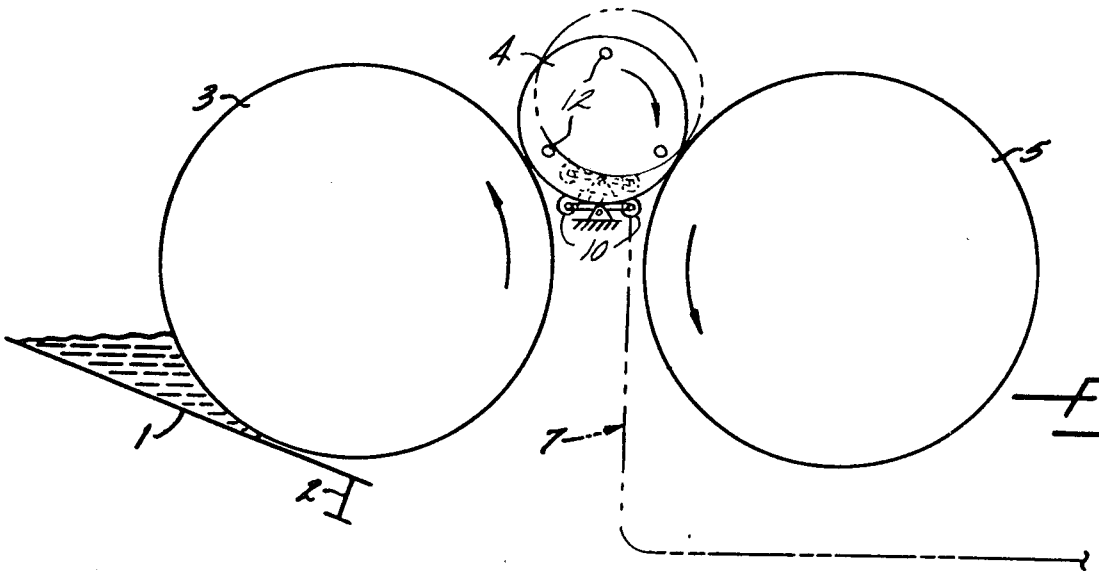
FIG. 2 is a construction similar to FIG. 1, in which the ink vibrator discs are controlled.

FIG. 2 shows an ink metering system similar to FIG. 1. The discs 4 have flat spacer bolts 12 on one side and are mounted on two support rollers 10 arranged at the two ends of a lever 11. A lever system 7 is so secured to the lever 11 that the vibrator discs 4 can be lowered from the phantom line position of FIG. 2 to the solid line position and applied against the duct roller 3 for different times in order to give extremely fine ink regulation.

The preferred arrangement of the lever 11 also allows simple modification of the continuous contact between the discs 4 and the transfer roller 5 in relation to the duct roller 3, and all that is required for this purpose is to change the basic angle of adjustment of the lever 11 with the lever system 7 by means of an adjustment screw. The discs 4 can be rapidly and inexpensively removed for repair purposes and cleaning.

As shown schematically in FIG. 3, the ink vibrator discs 4 are disposed in substantially contiguous side-by-side relationship and optimum ink transfer is obtained, i.e. there are no gaps on the transfer roller 5. With this system, the ink transfer is so satisfactorily controllable to meet the ink requirements that the inking unit roller 16 (see FIG. 1) can be designed without any distribution means. In other words, ink spreading and distribution directly at the plate cylinder is sufficient in the present ink metering system. Depending upon the printing machine space conditions in the inking unit zone, the lever systems 6 and 7 (see FIGS. 1 and 2) can be of various constructions.

FIG. 4 illustrates another ink metering system in which the duct roller 3 is at an angle of about 45° to the horizontal relatively to the transfer roller 5. Preferably, rollers 3, 5 are interconnected by a driving belt 15. Two rows of ink vibrator discs 4.1 and 4.2 are disposed between the rollers 3, 5, which rotate the discs by frictional engagement. As shown, the ink vibrator discs 4.1 are located in a staggered relationship to to the opposite ink vibrator discs 4.2 and both rows of discs are mounted eccentrically. The ink vibrator discs 4.1, 4.2 are controlled by way of eccentric lever systems 8, 8.1 and respective articulated control rods 13, 14. The control rods 14 can extend through the free spaces between the ink vibrator discs 4.1 which are laterally spaced apart.

In accordance with this embodiment, the film of ink is continuously fed in a predetermined thickness to the duct roller 3 by adjustment of a blade 2.1 and is transferred to the transfer roller 5 depending upon the contact time of the vibrator discs 4.1 and 4.2. If no ink is taken up by the discs 4.1, 4.2, it is returned to the duct 1 after one revolution of the duct roller 3. In this ink metering system, rotating double-sided vibrators can be used instead of the known rocking vibrators, in order to bring the ink to conventional machine speeds. Another feature of this solution is that optimum feed control is possible by means of the discs 4.1, 4.2 from zero to maximum without the transfer roller 5 having any empty gaps.

We claim as our invention:

1. An ink metering system for use with letterpress and offset printing machines including an ink duct with a blade and a duct roller with an ink vibrator, the latter consisting of a plurality of ink vibrator discs, which oscillate individually and independently of one another between the duct roller and a transfer roller, and wherein the width of each of the discs corresponds to a specific ink zone, characterized in that the duct roller and the transfer roller are driven at the same circumferential speed, the ink vibrator discs being disposed loosely between the duct roller and the transfer roller and driven by frictional contact with the transfer roller and the duct roller while being normally in contact therewith; and means for selectively raising each of the ink vibrator discs out of contact with at least one of the duct roller and the transfer roller under controllably defined conditions by means of an actuating lever system including a lever for each vibrator disc and at least one support roller journalled on each lever for engaging the outer surface for raising the respective vibrator discs.

2. An ink metering system according to claim 1, characterized in that the ink vibrator discs each have spacer means on at least one side thereof to separate adjacent discs.

3. An ink metering system according to claim 1, characterized in that the ink vibrator discs are each selectively movable into and out of contact with the duct roller by means of two support rollers disposed on a pivotable lever.

* * * * *